US009419386B2

(12) United States Patent
Liu et al.

(10) Patent No.: US 9,419,386 B2
(45) Date of Patent: Aug. 16, 2016

(54) INDICATION CIRCUIT FOR INDICATING TYPES OF VOLTAGES

(71) Applicant: ENNOCONN CORPORATION, New Taipei (TW)

(72) Inventors: Shih-Chi Liu, New Taipei (TW); Chia-Chun Liao, New Taipei (TW); Cheng-Jen Tseng, New Taipei (TW)

(73) Assignee: ENNOCONN CORPORATION, New Taipei (TW)

( * ) Notice: Subject to any disclaimer, the term of this patent is extended or adjusted under 35 U.S.C. 154(b) by 235 days.

(21) Appl. No.: 14/093,663

(22) Filed: Dec. 2, 2013

(65) Prior Publication Data

US 2014/0159909 A1 Jun. 12, 2014

(30) Foreign Application Priority Data

Dec. 7, 2012 (TW) ..... 101146050 A

(51) Int. Cl.
*G08B 5/36* (2006.01)
*H01R 13/66* (2006.01)

(52) U.S. Cl.
CPC ..... *H01R 13/6683* (2013.01); *H01R 13/6691* (2013.01); *H01R 2201/06* (2013.01)

(58) Field of Classification Search
CPC .. G08B 5/36; H01R 13/6683; H01R 13/6691; H01R 2201/06
USPC ..... 340/660
See application file for complete search history.

(56) References Cited

U.S. PATENT DOCUMENTS 6,094,189 A * 7/2000 Quillen ..... G02B 27/20 345/156
9,008,112 B1 * 4/2015 Lee ..... G06F 1/3215 315/291

FOREIGN PATENT DOCUMENTS

TW I346797 8/2011

* cited by examiner

*Primary Examiner* — Omer S Khan
(74) *Attorney, Agent, or Firm* — ScienBiziP, P.C.

(57) ABSTRACT

An indication circuit includes a recommended standard 232 (RS232) connector, first to fourth electronic switches, first and second light-emitting diodes (LEDs), and first to fourth resistors. When the RS232 connector outputs a first voltage, the first LED emits, when the RS232 connector outputs a second voltage, the second LED emits.

2 Claims, 2 Drawing Sheets

INDICATION CIRCUIT FOR INDICATING TYPES OF VOLTAGES

BACKGROUND

1. Technical Field

The present disclosure relates to an indication circuit for indicating types of voltages.

2. Description of Related Art

The recommended standard 232 (RS232) connector are widely used in the computer industry. The RS232 connector may provide various voltages between a computer and other devices, so that the devices may not need to acquire power from an external power source. Usually, the RS232 connector may provide 5 volts (V) or 12 V. However, a user may be unable to distinguish the RS232 connector with 5V from the RS232 connector with 12V.

Therefore, there is room for improvement in the art.

BRIEF DESCRIPTION OF THE DRAWINGS

Many aspects of the present disclosure can be better understood with reference to the following drawing(s). The components in the drawing(s) are not necessarily drawn to scale, the emphasis instead being placed upon clearly illustrating the principles of the present disclosure. Moreover, in the drawing(s), like reference numerals designate corresponding parts throughout the several views.

DETAILED DESCRIPTION

Figure 1:
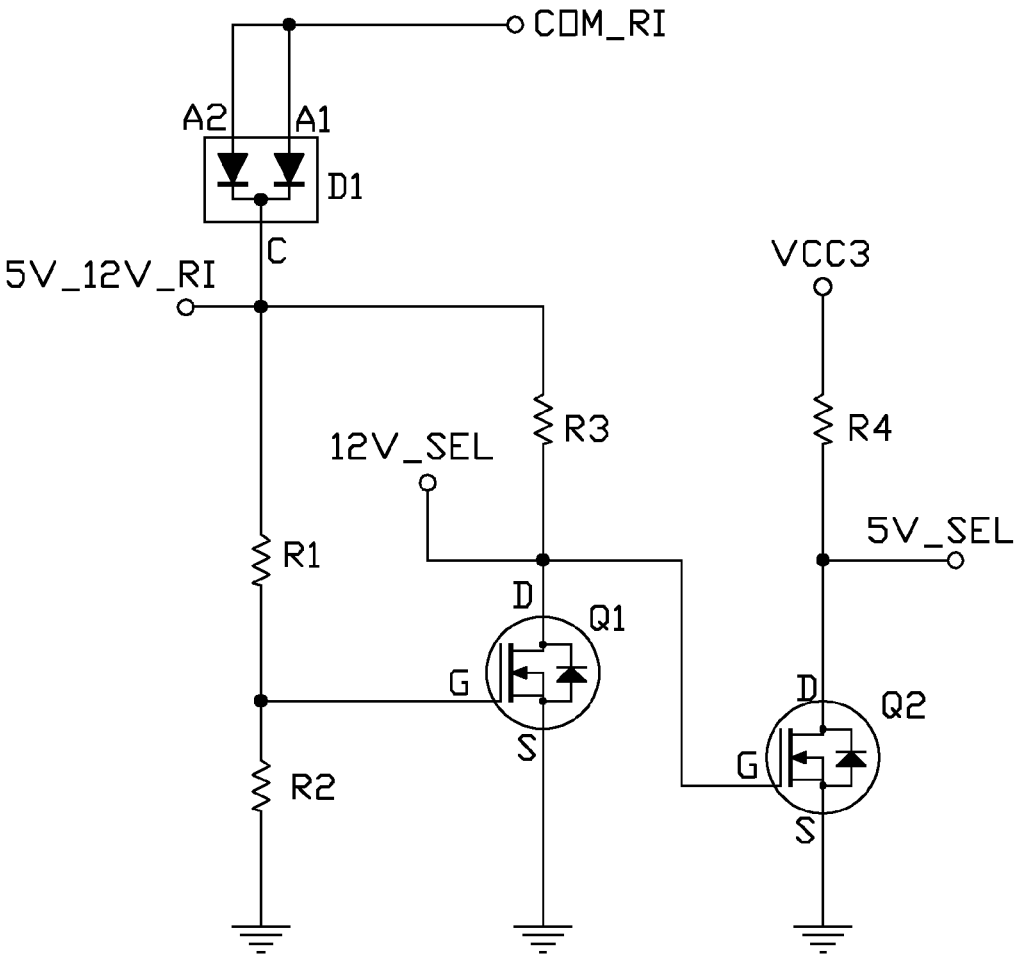
FIGS. 1 and 2 are circuit diagrams of an embodiment of an indication circuit of the present disclosure.
Figure 2:
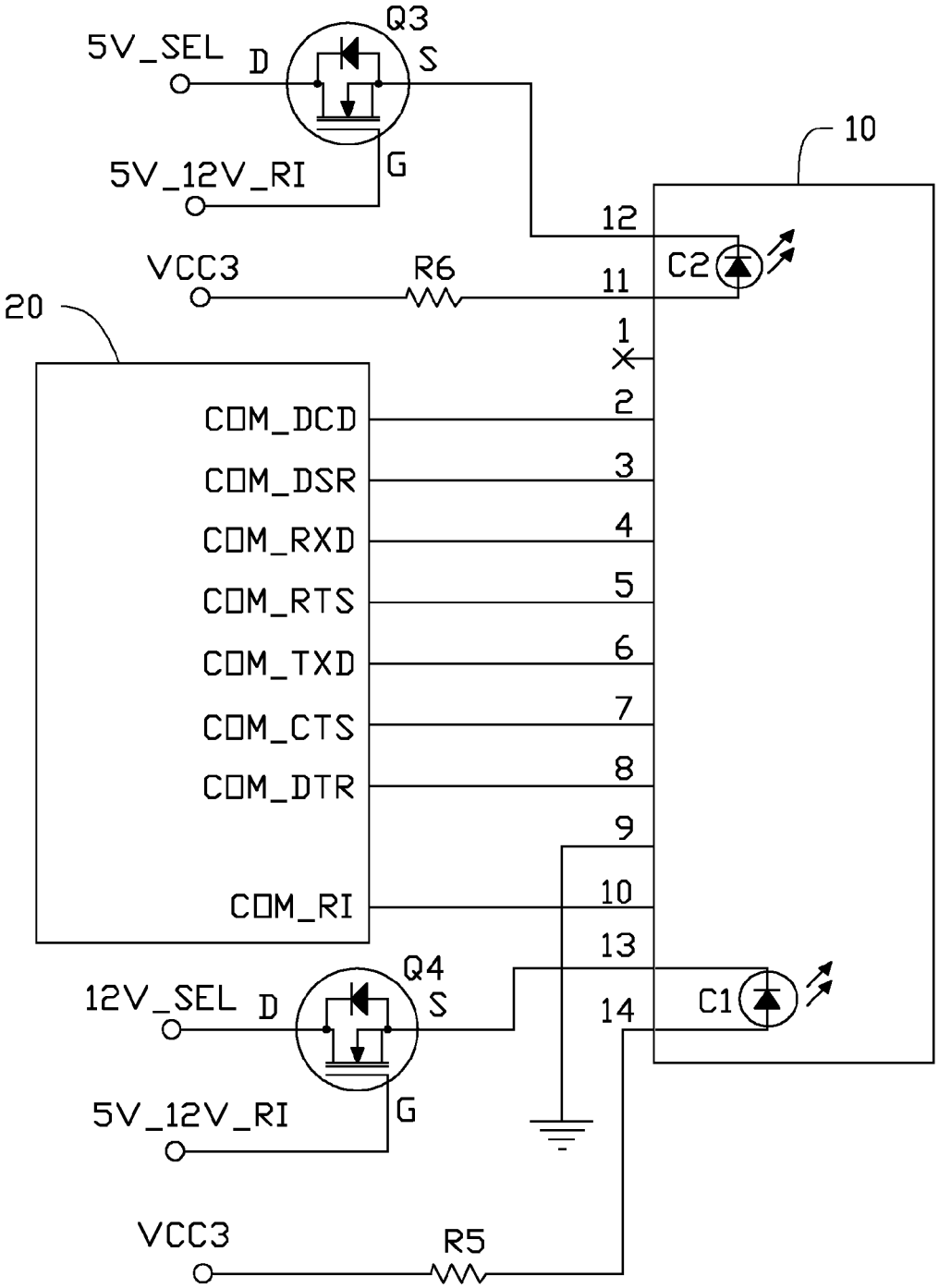

FIGS. 1 and 2 illustrate an embodiment of an indication circuit of the present disclosure. The indication circuit is used to indicate voltage values of a voltage acquired by a first recommended standard 232 (RS232) connector 10 from a second RS232 connector 20. In one embodiment, the second RS232 connector 20 may couple to a computer, and the second RS232 connector may couple to other component. The indication circuit includes a Schottky diode D1, six resistors R1-R6, four transistors Q1-Q4, and two light-emitting diodes (LED) C1 and C2.

The First RS232 connector 10 includes first to tenth pins 1-10. The first pin 1 of the First RS232 connector 10 is idle. The ninth pin 9 of the First RS232 connector 10 is connected to ground. The second to eighth pins 2-8 and the tenth pin 10 of the First RS232 connector 10 are coupled to a pin COM_DCD, a pin COM_DSR, a pin COM_RXD, a pin COM_RTS, a pin COM_TXD, a pin COM_CTS, a pin COM_DTR, and a pin COM_RI of the second RS232 connector 20, respectively.

Anodes A1 and A2 of the Schottky diode D1 is coupled to the tenth pin 10 of the first RS232 connector 10. A cathode C of the Schottky diode D1 is connected to ground through the resistors R1 and R2 in that order, and is also coupled to a drain D of the transistor Q1 through the resistor R3. A gate G of the transistor Q1 is coupled to a node between the resistors R1 and R2. Sources S of the transistors Q1 and Q2 are connected to ground. The drain D of the transistor Q1 is coupled to a gate G of the transistor Q2. A drain D of the transistor Q2 is coupled to a power terminal VCC3 providing 3 voltages (V), through the resistor R4, and is also coupled to a drain D of the transistor Q3. A gate G of the transistor Q3 is coupled to the cathode C of the Schottky diode D1. A source S of the transistor Q3 is coupled to a cathode of the LED C2. An anode of the LED C2 is coupled to the power terminal VCC3 through the resistor R6. A gate G of the transistor Q4 is coupled to the cathode C of the Schottky diode D1. A drain D of the transistor Q4 is coupled to the drain D of the transistor Q1. A source S of the transistor Q4 is coupled to a cathode of the LED C1. An anode of the LED C1 is coupled to the power terminal VCC3 through the resistor R5.

When the pin COM_RI of the second RS232 connector 20 provides 5V, the tenth pin 10 of the first RS232 connector 10 receives the 5V, so do the anodes A1 and A2 of the Schottky diode D1. The Schottky diode D1 is turned on. Accordingly, the voltage of the gates G of the transistors Q3 and Q4 is at 5V. The voltage of the gate G of the transistor Q1 is at 1.24V because of voltage division by the resistors R1 and R2, thus, the transistor Q1 is turned off, and the voltage of the drain D of the transistor Q1 is at 5V. The voltage of the gate G of the transistor Q2 is at 5V, so that the transistor Q2 is turned on, and the drain D of the transistor Q2 is at low-voltage level. The drain D of the transistor Q3 is also at a low-voltage level. In the meanwhile, the voltage of the gate G of the transistor Q3 is at 5V, to turn on the transistor Q3. Accordingly, the cathode of the LED C2 is at a low-voltage level, which makes the LED C2 emit light. The voltage of the gate G and the drain D of the transistor Q4 is at 5V, so that the transistor Q4 is turned on, and the voltage of the cathode of the LED C1 is 5V. The LED C1 will not emit light.

When the pin COM_RI of the second RS232 connector 20 provides 12V, the tenth pin 10 of the first RS232 connector 10 receives the 12V, so do the anodes A1 and A2 of the Schottky diode D1. The Schottky diode D1 is turned on. Accordingly, the voltage of the gates G of the transistors Q3 and Q4 is at 12V. The voltage of the gate G of the transistor Q1 is at 3V for the division voltage of the resistors R1 and R2, thus, the transistor Q1 is turned on, and the voltage of the drain D of the transistor Q1 is at low-level voltage, such as logic 0. The voltage of the gate G of the transistor Q2 is at low-level voltage, so that the transistor Q2 is turned off, and the voltage of the drain D of the transistor Q2 is 3V. The voltage of the drain D of the transistor Q3 is also at 3V. In the meanwhile, the voltage of the gate G of the transistor Q3 is at 12V, to turn on the transistor Q3. Accordingly, the voltage of the cathode of the LED C2 is at 3V, which makes the LED C2 not emit light. The voltage of the gate G of the transistor Q4 is at 12V, and the drain D of the transistor Q4 is connected to ground, so that the transistor Q4 is turned on, and the voltage of cathode of the LED C1 is at low-level voltage. The LED C1 emits light. Therefore, when the second RS232 connector 20 provides 5V, the LED C2 emits light, and the LED C1 does not emit light. When the second RS232 connector 20 provides 12V, the LED C1 emits light, and the LED C2 does not emit light.

When the second RS232 connector 20 provides no power, the LEDs C1 and C2 do not emit light.

In the embodiment, the transistors Q1-Q4 are n-channel metal oxide semiconductor transistors (NMOSFET).

While the disclosure has been described by way of example and in terms of preferred embodiment, it is to be understood that the disclosure is not limited thereto. On the contrary, it is intended to cover various modifications and similar arrangements as would be apparent to those skilled in the art. Therefore, the range of the appended claims should be accorded the broadest interpretation so as to encompass all such modifications and similar arrangements.

What is claimed is:

1. An indication circuit, comprising:

a first recommended standard 232 (RS232) connector;

a second RS232 connector coupled to the first RS232 connector and outputting signal to the first RS232 connector;

first to fourth electronic switches each comprising first to third terminals;

first and second light-emitting diodes (LED); and a Schottky diode;

wherein the first terminal of the first electronic switch is coupled to a cathode of the Schottky diode through a first resistor, and the first terminal is also connected to ground through a second resistor; the second terminal of the first electronic switch is connected to ground, the third terminal of the first electronic switch is coupled to the cathode of the Schottky diode through a third resistor, and is also coupled to the first terminal of the second electronic switch; the second terminal of the second electronic switch is connected to ground, the third terminal of the second electronic switch is coupled to a power terminal through a fourth resistor, the first terminal of the third electronic switch is coupled to the cathode of the Schottky diode, the second terminal of the third electronic switch is coupled to a cathode of the second LED, the third terminal of the third electronic switch is coupled to the third terminal of the second electronic switch; an anode of the second LED is coupled to the power terminal through a sixth resistor; the first terminal of the fourth electronic switch is coupled to the cathode of the Schottky diode, the second terminal of the fourth electronic switch is coupled to a cathode of the first LED, the third terminal of the fourth electronic switch is coupled to the third terminal of the first electronic switch; an anode of the first LED is coupled to the power terminal through a fifth resistor;

wherein when the first terminals of the first to fourth electronic switches are at high-level voltage, the first to fourth electronic switches are turned on; when the first terminals of the first to fourth electronic switches are at low-level voltage, the first to fourth electronic switches are turned offs;

wherein first and second anodes of the Schottky diode are couple to the first pin of the second connector the first LED emits when the second RS232 connector outputs a first voltage, and the second LED emits when the second RS232 connector outputs a second voltage;

wherein the first to fourth electronic switches are n-channel metal oxide semiconductor transistors (NMOSFETs), the first, the second, and third terminals of the first to fourth electronic switches are gates, sources, and drains of the NMOSFETs, respectively.

2. The indication circuit of claim 1, wherein when the second RS232 connector outputs no voltage, the first and second LEDs do not emit.

* * * * *